United States Patent [19]

DiFrancesco et al.

[11] 4,158,500

[45] Jun. 19, 1979

[54] APPARATUS FOR PRODUCING COLLATED COPIES IN PAGE SEQUENTIAL ORDER

[75] Inventors: Alphonse B. DiFrancesco, Penfield; Charles T. Hage, Rochester, both of N.Y.

[73] Assignee: Eastman Kodak Company, Rochester, N.Y.

[21] Appl. No.: 901,922

[22] Filed: May 1, 1978

Related U.S. Application Data

[63] Continuation of Ser. No. 768,666, Feb. 14, 1977, abandoned.

[51] Int. Cl.[2] ..... G03G 15/00

[52] U.S. Cl. ..... 355/14; 271/3.1; 271/4; 355/23; 355/26

[58] Field of Search ..... 355/14, 3 R, 23, 24, 355/26; 271/3.1, 4

[56] References Cited

U.S. PATENT DOCUMENTS 3,615,129 10/1971 Drawe et al. ..... 355/26 X 3,841,754 10/1974 Drexler et al. ..... 355/24 X 3,862,802 1/1975 Till ..... 355/23

*Primary Examiner*—R. L. Moses

*Attorney, Agent, or Firm*—G. Herman Childress

[57] ABSTRACT

Apparatus for producing duplex or simplex collated copies from duplex and simplex originals comprising a copier having a duplexing section with two transfer stations separated by a copy-sheet inverter. A document feeding section circulates and recirculates original sheets, one-after-another, for producing sets of copies in page-sequential order. The document feeder is provided with a single hopper for receiving and maintaining the originals in their usual page sequence or order so that no preparation (i.e., special arrangement) of an original is necessary prior or subsequent to copying for making collated copies. The duplexing section requires only a single fuser that is positioned so that the copy sheets pass through both transfer stations before entering the fuser, thus permitting transfer of images under similar conditions in both transfer stations.

21 Claims, 5 Drawing Figures

APPARATUS FOR PRODUCING COLLATED COPIES IN PAGE SEQUENTIAL ORDER

This is a continuation of application Ser. No. 768,666, filed Feb. 14, 1977, now abandoned.

CROSS-REFERENCE TO RELATED APPLICATIONS

Reference is made to U.S. patent application Ser. No. 691,938 entitled APPARATUS FOR PRODUCING COLLATED COPIES FROM TWO-SIDED ORIGINALS, filed in the name of G. B. Gustafson on June 1, 1976, now abandoned, a continuation of such application having been filed as Ser. No. 867,842 on Jan. 9, 1978; and U.S. patent application Ser. No. 691,937 entitled APPARATUS FOR PRODUCING DUPLEX COLLATED COPIES, filed in the name of J. Connin, on June 1, 1976 now U.S. Pat. No. 4,099,150.

BACKGROUND OF THE INVENTION

The present invention relates to reproduction apparatus. More specifically, the invention relates to copiers having duplexing capabilities, and to document feeders that circulate original document sheets automatically, for producing duplex or simplex collated copies in page-sequential order without a sorter.

It is well known in the prior art to provide copiers with duplexing capabilities, with document feeders that circulate the original in a manner suitable for producing collated copies, or with document inverters that present both faces of the document for copying. Examples include: (1) in relation to the first feature—U.S. Pat. Nos. 3,318,212; 3,536,398; 3,548,783; 3,615,129; 3,630,607; 3,645,615; 3,671,118; 3,672,765; 3,687,541; 3,697,171; 3,775,102; 3,844,654; 3,856,295; 3,862,802; 3,866,904; 3,869,202; 3,947,270, and Research Disclosure Publication No. 14237, Vol. 142, Feb. 1976 (available from Industrial Opportunities Ltd., Homewell, Havant, Hampshire, P.O. 9-1EF, United Kingdom; (2) in relation to the second feature—U.S. Pat. Nos. Re. 27,976; 3,552,739; 3,556,511; and 3,709,595; (3) and, in relation to the third feature U.S. Pat. Nos. 3,227,444; 3,416,791 and 3,675,999.

It is also known in the prior art to combine certain of the above mentioned features in a unified structure or control. U.S. Pat. No. 3,630,607 discloses a collating feeder on a copier having duplex capabilities. U.S. Pat. No. 3,844,653 discloses a copier having duplex capabilities with a document inverting mechanism. U.S. Pat. No. 3,862,802 discloses a duplex copier with a document inverting mechanism, and is said to be useable with a sorter to produce collated copies. Research Disclosure, Vol. 133, No. 13329, May 1975 discloses a manual approach for producing collated duplex copies without a sorter.

The cross-referenced patent applications Ser. Nos. 691,937 and 867,842 present further improvements in copy and document handling. Both relate to apparatus for yielding duplex or two-sided copies in a fully automatic manner, and for producing collated copies without the burden of a sorter. Both also include recirculating, inverting document feeders and duplexing copy processors that are particularly conducive to simplified finishing operations. Application Ser. No. 867,842 discloses apparatus for producing copies in page-sequential order, thus enhancing still further the convenience and efficiency of copying.

The above-mentioned patents and applications disclose an impressive number of features for supplementing the basic copying function to facilitate the total copying operation. Certain disadvantages remain, however, and it is to the alleviation of these disadvantages that the present invention is directed. In some cases, for example, prior approaches include two document hoppers and a document preparation step. While satisfactory for their intended purposes, the two hopper approaches suffer from the disadvantages of multiple feeders, extended guide channels and undesirable document preparation steps. In addition, and referring now to copy handling aspects, prior approaches suggest a "double pass" approach, where the copy sheets are transported along a somewhat tortuous path through the fuser and back to the photoconductor between the transferring of images to opposite faces of the sheets. With such approaches, the intermediate fusing operation adversely effects the condition of copy sheets and can complicate copy handling. Still another problem relates to relatively long copy-sheet paths. When short documents of two or three pages are copied, for example, it may take longer for the first copy sheet to return the second time to the photoconductor than to present all of the other copy-sheets the first time. This reduces the ability of the copier to handle some jobs efficiently.

SUMMARY OF THE INVENTION

The present invention alleviates the above and other deficiencies of prior copiers without sacrificing the advantages of producing copies in page-sequential order. In accordance with one feature, a copier can operate with simplex or duplex originals in their usual sequence, so that no particular preparation of the original is necessary prior or subsequent to copying. In accordance with another feature, images can be transferred to both faces of a copy sheet prior to fusing, so that the condition of the copy sheet, and especially its moisture content, will be the same for both transfers. Still another feature reduces the copy path from that required for conventional double pass duplexing so that more types of jobs, and especially those concerned with documents of only a few pages, can be run more efficiently.

In accordance with preferred embodiments of the invention a document feeding section presents one or both faces of the original sheets to be copied. A process section establishes representations of the original-sheet faces. A copy duplexing section presents one or both faces of the copy sheets to receive the representations established in the process section.

A preferred document feeding section receives the originals face-up in their normal page-sequential order, repeatedly circulates the simplex or duplex document sheets for copying one-sheet-after-another, in page-sequential order, last-page first, and returns the copied sheets to their original page-sequential order. During each circulation of a duplex document sheet, it is fed along a non-inverting path (i.e., it is inverted zero or even number of times) before it is copied. Then it is inverted an odd number of times before it is copied again, and finally an odd number of times before it is returned face up to its original position in its normal sequence. During each circulation of a simplex document sheet, it is inverted an odd number of times before it is copied and an odd number of times before it is returned face up to its original position.

A copy section for use with such a feeding section includes two transfer stations and between the stations there is a copy sheet inverter. Means are provided for transporting the copy sheets through the respective stations and inverter to transfer images to both faces of the copy sheets. Thereafter the images are fused to the copy sheets. When simplex copies are to be produced, one transfer station and the inverter are bypassed.

Still other aspects and more specific features will become apparent to those skilled in the art from the following descriptions with reference to the accompanying drawings.

BRIEF DESCRIPTION OF THE DRAWINGS

In the detailed description of the preferred embodiment of the invention presented below, reference is made to the accompanying drawings, in which.

DESCRIPTION OF THE PREFERRED EMBODIMENT

Figure 1:
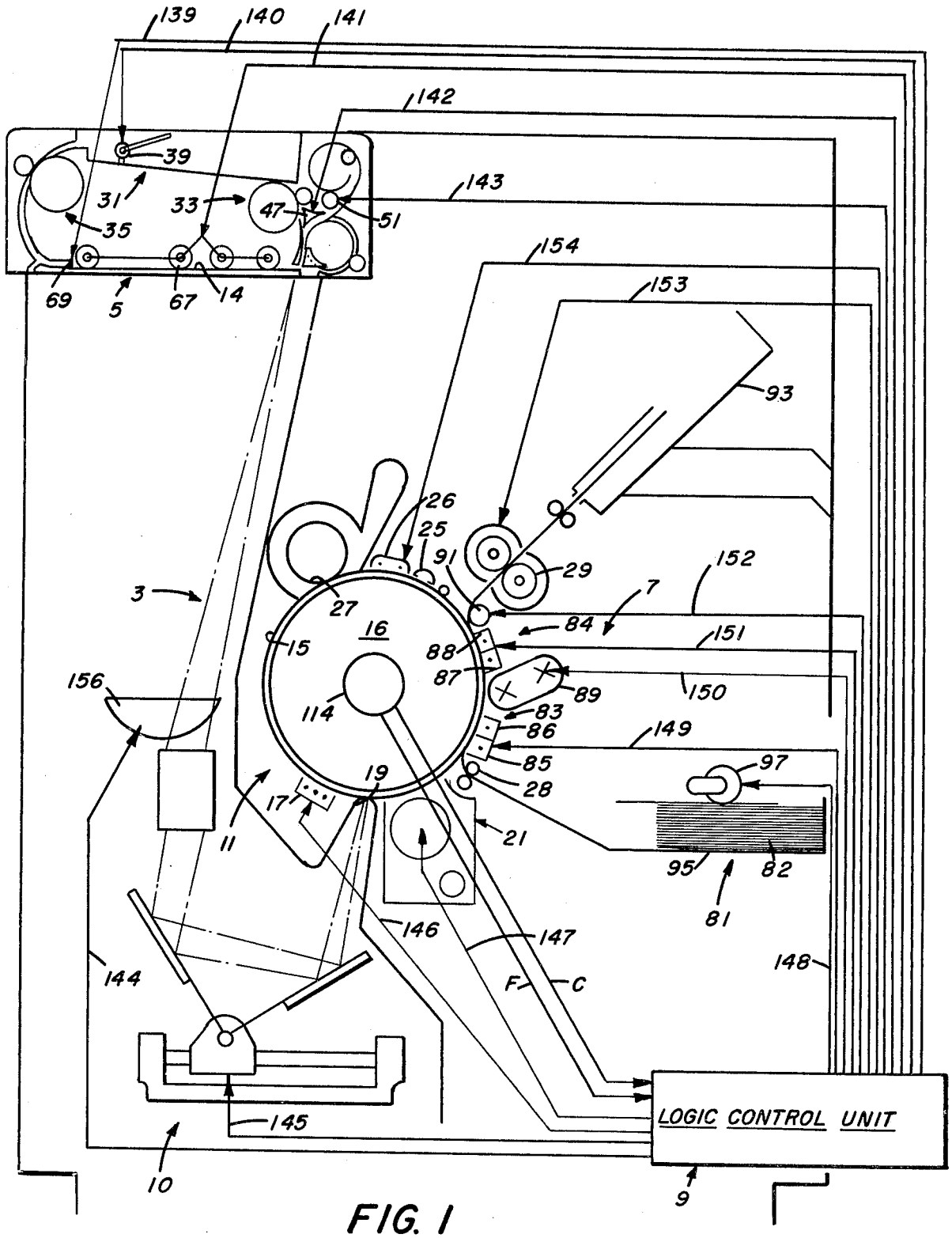
FIG. 1 is a schematic representation of a copier having simplex and duplex capabilities in accordance with a preferred embodiment of the present invention.

Referring now to the drawings, and especially to FIG. 1, a copier is depicted in accordance with a preferred embodiment of the present invention, comprising a process section 3, a document feeding section 5, a copy duplexing section 7, and a logic and control unit 9. The process section 3 includes an imaging device or projector 10 and a processor 11 for establishing visible representations of original document sheets, typically as image-wise distributions of marking particles. The document feeding section presents the original sheets to the process section for establishing the visible representations, while the copy duplexing section, in synchronism with the feeding section, presents the copy sheets to the process section for receiving the visible representations forming the final copies. The logic and control unit coordinates the operation of the three sections as required.

The term "original" as used herein refers to the object to be copied, including documents and masters in cut or sheet form and comprising one or more sheets or pages. A "sheet," "support" or "supporting medium" of the original is used in reference to a single expanse of thin, essentially flat material, such as paper, microfilm or a transparency having two opposed faces or sides. A "page" of an original is a face or side of one sheet bearing an image, marking or information to be copied. A single sheet or an original may include one or two pages depending on whether one or both faces include material to be copied. A "simplex" original includes one page per sheet; a "duplex" original, two pages per sheet. Reference to sides or pages by number or as "odd" or "even" refers to a sequential numbering of the sides or pages in order from what conventionally is considered the front of the original to its back, and does not depend on how the pages are actually numbered. A simplex original would have pages 1 and 2 on separate sheets. In a duplex original, pages 1 and 2 conventionally would be on opposite sides of the same sheet. "Page-sequential order" refers to the order: page 1, page 2, page 3, page 4, etc., whether in connection with simplex or duplex originals, and to the reversed order; page 4, page 3, page 2, and page 1.

The term "copy" refers to duplicates of the original in the usual sense, including receivers or supporting mediums and having sheets, faces or sides, and pages as those terms are defined above. A "collated" copy is one that has its pages in the same sequential order as the original, but not necessarily the same page arrangement. A simplex original can be duplex in its copy, and still be collated.

Process Section (FIG. 1)

The process section 3 can be selected from suitable designs known to those skilled in the art, and a brief reference to its general configuration is considered sufficient for the purpose of the present description. A scan/drum arrangement is depicted in which the imaging device 10 includes scanning optical and illumination platen 14, while the processor 11 includes a photoconductor 15 supported on a drum 16 for movement in a cylindrical or closed path.

As the photoconductor moves in its path, it is acted upon by various processing stations. Proceeding counterclockwise, in the direction of drum rotation, the photoconductor is sensitized by a corona charger at station 17, is exposed by the imaging device at station 19, is developed by a magnetic brush at a station 21, moves through corona transfer and detack stations to be described hereinafter, is erased by illuminators and corona chargers at stations 25 and 26, respectively, and is cleaned by a vacuum brush or the like at station 27. Two additional processing stations 28 and 29 are spaced from the photoconductor in a copy duplexing path. These stations include a registration device and fuser, respectively.

In operation, the imaging device 10 sequentially scans the images from successive original sheets onto successive frames along the photoconductor, where visible representations of the original sheets are established as image-wise distributions of marking particles which successively are transferrable to copy sheets. A further description of the above-mentioned stations, and the imaging device, is presented in Research Disclosure Publication No. 14144, Vol. 141, January, 1976.

Other arrangements that could be modified to practice the invention in accordance with the teachings of the present specification are disclosed in U.S. Pat. No. 3,914,047 entitled SYNCHRONIZING CONTROL APPARATUS FOR ELECTROPHOTOGRAPHIC APPARATUS UTILIZING DIGITAL COMPUTER, issued on Oct. 21, 1975 in the name of William E. Hunt, et al; and 3,876,106 entitled TONER CONCENTRATION MONITORING APPARATUS UTILIZING PROGRAMMABLE DIGITAL COMPUTER, issued on Apr. 8, 1975 in the name of Stephen R. Powell et al. These last-mentioned patents disclose copiers of the so-called flash/web type.

Figure 3:
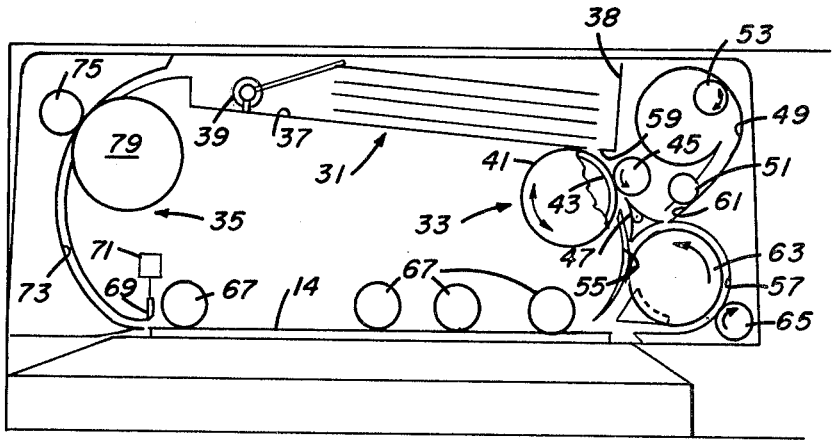
FIG. 3 is a schematic illustration of the feeder depicted in FIG. 1, but depicting additional structural features thereof.
Figure 4:
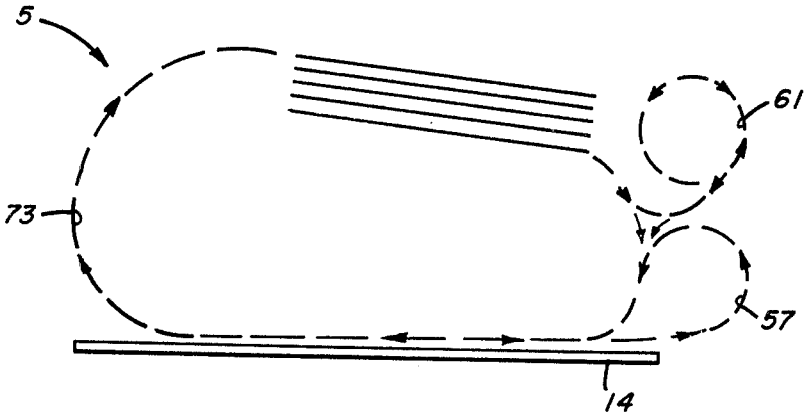
FIG. 4 is a schematic view depicting the document path and mode of operation of the document feeding section in accordance with the preferred embodiment.

Document Feeding Section (FIGS. 1 and 3)

The document feeding section 5 includes a hopper 31, a sheet presenting portion 33 and a sheet returning portion 35. The hopper is adapted to receive a set of original sheets face up in their normal page-sequential order, to deliver the sheets one-after-another, last sheet first, from the bottom of the document set, and to receive the sheets, each sheet on top of previously delivered sheets, at the top of the document set. The sheet-presenting portion 33 removes the sheets sequentially from one end at the bottom of the hopper, presents the removed sheet with one face engaging the platen 14 for copying, and then re-presents the sheet with its other face engaging the platen. The sheet-returning portion 35 removes the sheet from the platen after both of its faces have been copied and returns the sheet to the hopper in the original order of the document set.

Referring now more specifically to the structural details of the document feeding section, and to FIG. 3 in particular, the hopper 31 is located above and spaced from the platen 14 where it is readily accessible for receiving and supporting the set of original document sheets. Of conventional design, the hopper includes a sloping tray 37 for assisting in aligning the document sheets against forward wall 38, suitable side guides and joggers, not shown, and a set-completed detector 39 for determining, without counting, when (each time) the set of original sheets has been copied. Further details of the preferred hopper are illustrated and described in commonly assigned, copending U.S. patent application Ser. No. 647,683, entitled RECIRCULATING SHEET FEEDER, filed on Jan. 8, 1976 in the name of Matthew J. Russel, such being a continuation of application Ser. No. 523,610, filed on Nov. 13, 1974 (now abandoned), the disclosure which is incorporated by reference into the present application.

The sheet presenting section 33 includes a first part defined by an oscillating vacuum pick-off device 41, a driving nip between ring 43 and back-up roller 45, and a sheet diverter 47; a second part including a non-inverting sheet path 61, 49, the curved portion 49 being generally in the shape of a snail shell 49, and two driving rollers 51 and 53; and a third part including means defining first and second sheet inverting paths 55 and 57, respectively.

The first part of the sheet presenting sections removes the sheets from an exit 59 at one end of the hopper tray 37 and directs the removed sheet into a selected one of the inverting path 55 or the non-inverting paths 61 and 49, depending on the position of diverter 47. As depicted more fully in the above-mentioned application Ser. No. 647,683, the sheets are removed at first by the vacuum pick-off device, which draws one end of the sheet out of the exit, and then by the driving nip, which propels the sheet into the selected path.

The second part of the sheet presenting section directs the removed sheet to the platen 14 without inverting the sheet; or, stated differently, with the last face (even page) of the document facing down and engaging the platen just as it faced down in tray 37. In one sense, as mentioned above, this part defines a non-inverting document path leadng from the hopper to the platen. In another sense, however, it is a disabling device which renders the inverting path 55, through which the sheets subsequently pass, ineffective to invert the sheet. The non-inverting path comprises a closed-end passageway. While the portion of the passageway designated 49 is shown in a snail shell shape, it will be apparent that other shapes can be used. The particular shape will depend, in part, on the space available within the feeder housing. In operation, a sheet entering this part via diverter 47 will be directed through path 61 and into the snail shell 49. The motive force of rollers 51 and 53 advance the sheet until the trailing end of the sheet clears the diverter. The diverter is moved and rollers 51 and 53 are then reversed to drive the sheet from the non-inverting path into path 55 and then onto the platen 14. The sheet is moved across the platen by rollers 67.

The third part of the sheet-presenting section temporarily removes the sheet from the platen, after the first face of the sheet has been copied, and inverts or turns the sheet over for copying its other face. This is accomplished by the rollers 67 which advance the sheet into the inverting path 57, and the driving rollers 63 and 65, which propel the sheet around path 57, through 360 degrees, and back onto the platen.

A sheet registration and exposure station comprises platen 14, rollers 67, and a registration gate 69. On entering the exposure station, a document sheet is driven by the rollers 67 into a registered position against the gate. After the first face of the sheet is copied, the rollers are reversed, once to drive the sheet into the second inverting path 57, and again to re-register the sheet for copying the second face. Then, after the second face has been copied, the gate is removed by solenoid 71 and the rollers 67 drive the sheet into the sheet returning portions 35 of the feeder.

The sheet returning portion 35 includes a sheet inverting path 73 and two drive rollers 75 and 79 for guiding and driving the document sheet from the platen to hopper 31 and on top of the set from which it originally was removed.

The non-inverting path 61, 49, as described above, maintains the original orientation of the sheet faces from the hopper to the platen in the sense that the sheet, while it may be curled in the snail shell, is never turned over entirely. It should be apparent to those skilled in the art, however, that an even number of sheet inversions also would present the sheet to the platen with the same side down for copying. The snail sheel could be eliminated, for example, and the inverting path 57 could then be used twice (i.e., an even number of times) before copying. This would present the original faces in the same order as the structure described above. In similar respect, the inverting paths 55, 57 and 73 could have one or any other odd number of inversions and still operate for the purpose described.

The feeder is referred to sometimes as a circulating or recirculating feeder because the sheets move in the feeder repeatedly from the hopper to the exposure platen and back to the hopper in a manner which simulates a closed-loop or circuitous path. It is a collating feeder because it is capable of feeding sheets in an appropriate sequence for producing collated copies without a sorter. This aspect of the feeder will become more apparent from the following description. It is also a duplexing feeder in the sense that it can feed simplex or duplex document sheets in a manner suitable for generating duplex copies.

For the purpose of simplifying this description, it will be assumed throughout most of this specification that the feeder and copier are operating in a collating duplexing mode with a duplex original. It should be understood, however, that many of the feeder's advantages relate to its flexibility and convenience in other modes of operation. Such other modes might include, for example, capabilities for feeding without collating, for producing simplex copies from simplex originals, for producing duplex copies from simplex originals, and for producing simplex copies from duplex originals. In the non-collating mode, each page would be presented to the platen once regardless of the number of copies to be made. When making simplex, collated copies from simplex originals, the feeder would operate generally as described in the above-mentioned application, Ser. No. 647,683, i.e., the lowermost sheet in hopper 31 is removed by pick-off device 41, fed through inverting path 55 to the platen for registration and copying, and then advanced through inverting path 73 back to the top of the stack of sheets in the hopper. Images would be transferred to only one side of the copy sheets. The same would be true for duplex copies from simplex originals, insofar as the feeder is concerned, but the copy duplexing section would present both faces of the copy sheets to the photoconductor for receiving visible representations as described hereinafter.

Figure 5:
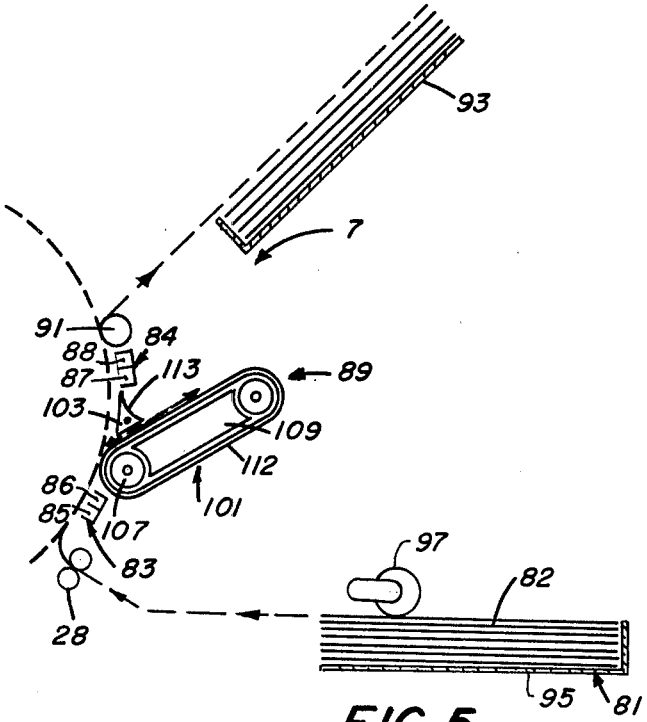
FIG. 5 is a schematic view depicting the copy path and mode of operation of the copy processor in accordance with the present invention and as described more fully in the description of the preferred embodiment that follows.

Copy Duplexing Section (FIGS. 1 and 5)

The copy duplexing section 7 includes one or more supply hoppers 81, for receiving a stack of copy supports 82. The supports are fed from the hopper to the process section, the registration device 28, first and second transfer stations 83 and 84, including transfer and detacking coronas 85, 86, 87, and 88, a sheet inverter 89, a vacuum stripping roller 91 and an exit hopper 93.

The supply hopper can be similar in many respects to the hopper 31 of the document feeder, including a support tray 95 and pick-off device 97 for withdrawing support sheets, one after another, from a stack of such sheets, and for directing the withdrawn sheets toward the photoconductor along suitable guide channels.

Registration device 28 momentarily interrupts movement of the copy sheets for their proper alignment with the appropriate image frame on the photoconductor, after which the sheets are directed into engagement with the photoconductor with the same relative velocity as the photoconductor.

At the first transfer station 83, a D.C. transfer corona 85 applies a charge to the face of the copy sheet adjacent the charger. This electrostatically tacks the copy sheet to the photoconductor and transfers the visible representation or image-wise distribution of marking particles, formed by the previously described process section, from the photoconductor to the copy support. The detacking corona 86, an A.C. corona, then eliminates the electrostatic forces tacking the copy to the photoconductor for facilitating the removal of the copy sheet from the photoconductor with the visible image on the just removed face of the copy support.

Sheet inverter 89 includes a relatively short vacuum transport 101, and stripping and diverting fingers 103, for removing the sheet from the photoconductor and re-presenting its opposite face thereto. The vacuum transport is coupled to an appropriate source for maintaining a vacuum in end roller 107 and plenum 109, which vacuum communicates with the copy supports by way of perforations in belt 112. As the copy support exits from the first detacking corona 83, it is drawn off of the photoconductor and onto the belt 112 by the vacuum in roller 107. Stripping finger 103 also may be of assistance, but preferably contacts only that face of the copy support which has not received an image, since the image has not been fixed and may be somewhat easy to smear. When the copy support is completely removed from the photoconductor, and its trailing end has cleared the diverting finger 103, the belt 112 is reversed for returning the copy support to the photoconductor along path 113, defined by the diverting finger 103, with its other side engaging the photoconductor and in registration with the next appropriate image on the photoconductor.

The second transfer station 84 is substantially identical to the first, and operates to transfer another image to the face of the copy support then engaging the photoconductor, after which the detacking corona 88 prepares the support for its removal the second time from the photoconductor. This transfer and detack are accomplished without disturbing the unfused toner on the first face of the copy support.

The vacuum stripping roller 91 draws the copy support from the photoconductor and directs the support through the fuser 29 and on to exit hopper 93, where each sheet is delivered on top of previously delivered sheets, and with the image last-transferred facing up. Of course other stripping devices could be used in place of the roller 91. In a copier employing a flexible web, for example, the web may be trained to follow a relatively sharp contour which will separate the copy support from the web. Similarly, once stripped from the photoconductor, the copy support could be transported to the fuser without contacting either face of the support. A number of devices for accomplishing this purpose are available in the prior art. An exemplary device of this type is described and illustrated in commonly assigned copending U.S. patent application Ser. No. 768,665 filed on Feb. 14, 1977 in the names of A. B. DiFrancesco and C. T. Hage, the disclosure of which hereby is incorporated by reference into the present application.

The duplexing approach just described is referred to as single-pass duplexing because no intermediate hopper is required. Instead, the copy supports move directly from a supply hopper to an exit hopper or finisher and with only a single pass through a fuser. Other examples of single pass duplexers are presented in previously referenced U.S. Pat. Nos. 3,672,765; 3,869,202; and 3,947,270.

Overall Operation

Referring now to the overall operation of the copier, a document or other original comprising a set of individual sheets is calculated and recirculated one-sheet-after-another from the hopper 31 to the exposure station or platen 14 and back to the hopper 31. Using the example of a six-page duplex original, the sheet defining pages five and six is circulated first, for copying page six and then page five, followed by the sheet defining pages four and three and finally the sheet defining pages two and one. The sheets are presented for copying in sequential order, from page six to page one, and each page is exposed only once during each respective circulation, for producing collated copies without a sorter. Multiple copies of a set of original sheets are generated by circulating and recirculating the sheets a number of times equal to the number of set copies desired.

As the pages sequentially are presented for copying, a succession of images representing the presented pages are established in frames of the photoconductor, one-following-another, in the same sequential order as the original pages were presented, i.e., page 6, page 5, page 4, page 3, page 2, and page 1. The images are rendered visible at the development station 21 and are moved by the rotating photoconductor into position for sequential transfer to alternate sides of copy supports at the first and second transfer stations 83 and 84. The even pages would be transferred at the first station 83 and the odd pages at the second station 84.

For each circulation or recirculation of a duplex document sheet, it is presented twice for exposure and two images are established. Similarly, one copy support is presented to the process section for receiving the two images, first on one face and then the other. The first copy support will receive an image representing page six on one side and then page five on the other. The next copy support will receive pages four and three, and the following copy support pages two and one. Of course additional copies will be generated in the same order and deposited on top of the earlier copies in the exit hopper.

Figure 2:
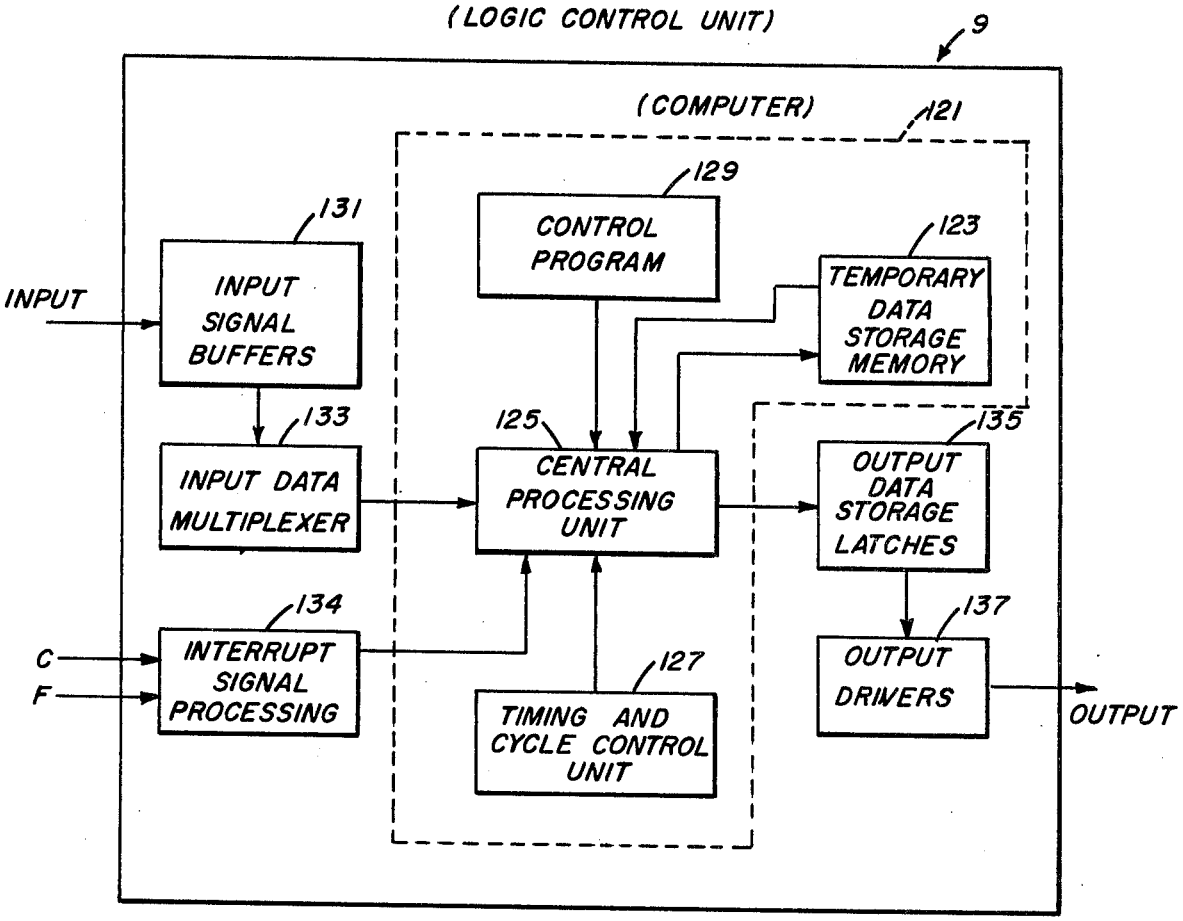
FIG. 2 is a schematic view depicting in general suitable logic and control for use with the copier represented in FIG. 1.

Logic and Control Unit (FIGS. 1 and 2)

A logic and control unit for accomplishing the above modes of operation is depicted in FIGS. 1 and 2. Its function generally is to coordinate the activities of the process section, the feeding section, and the duplexing section. Such a coordinating function could be implemented by relays, transistors, small and medium scale digital integrated circuits and the like. In this particular embodiment, a microcomputer 121 (FIG. 2) is utilized. The combination and sequential logic requirements of the process are established in a control program 129, which provides instructions to a central processing unit 125 to control the states of output signals based upon the status of input and timing signals. The timing signals can be derived from incremental encoder 114 (FIG. 1) connected to the drive means of the photoconductor drum to provide information required to relate the position of the moving photoconductor to the positions of the fixed process stations.

The input and output signals are represented in FIG. 1 by reference characters 139–154. Taken in order these characters identify control leads as follows:

139—leads to the registration gate 69, of the document feeder, for controlling its two positions (raised and lowered or present and removed);

140—leads to the set-completed detector 39 for counting the number of copies completed;

141—leads to the sheet propelling rollers 67 for establishing their direction of rotation;

142—leads to the sheet diverter 47, of the document feeder, for controlling its two positions (inverting and not inverting);

143—leads to propelling rollers 51 and 53 for determining their directions of rotation;

144—leads to the illumination source 156 for controlling the intensity of illumination and scanning control;

145—leads to the image projector 10 for controlling optical scanning in synchronism with the illumination source;

146—leads to the primary charger 17 for maintaining uniform charging;

147—leads to the fuser 21 for bias control;

"C" and "F" lead to the shaft encoder for acquiring timing signals (count and frame signals);

148—leads to sheet feeding roller 97 for initiating sheet feeding from hopper 81;

149—leads to the transfer and detacking coronas in the first transfer station for transfer control;

150—leads to the turn around device 89 for determining the direction of movement of belt 112;

151—leads to the transfer and detacking coronas 87 and 88 in the second transfer station again for transfer control;

152—leads to the stripping roller 91 for controlling its stripping action;

153—leads to the fusing station 29 for temperature control; and

154—leads to the erase and cleaning stations 25, and 26, for controlling their intensities of operation.

Of course additional leads could be applied as desired to effect the intended operation, including on and off operation of the various stations. Further descriptions of suitable control devices are presented in previously referenced U.S. Pat. No. 3,914,047, and in commonly assigned copending U.S. patent application, Ser. No. 671,865, entitled ORIGINAL DOCUMENT REARRANGEMENT APPARATUS FOR USE IN RECIRCULATING FEEDERS, filed in the name of Michael G. Reid, et al, said application having been converted to Defensive Publication No. T957,006, published Apr. 5, 1977.

Under the influence of the logic and control unit, the presentation to the process section of the original and copy sheets, and their inversion, is coordinated so that the copies will be collated in the page-sequential order described above. For each presentation of an original sheet, an exposure is made to establish a visible representation of one face of that sheet, and for each visible representation that is established, a copy sheet face is presented to receive it. Thus, the original and copy sheet faces are fed on a one-for-one basis. This is not to say that there are an equal number of original and copy sheets, which would not be the case, of course, when multiple copies are generated, but rather that there is one-for-one correspondence in the presentations of the respective sheet faces to the process section. Nor is it intended that the original and corresponding copy sheets must be fed at the same time. Generally, the feeding of an original sheet is displaced in time from the feeding of its corresponding copy sheet, either forward or backward, depending upon the machine configuration.

The logic and control unit also tracks the copies as they are made, and directs the document feeding and copy duplexing sections so that the first and second faces of the copies will properly correspond with the first and second faces of the original.

Offset stacking, stapling and other finishing operations have not been depicted. It is intended, however, that such apparatus be controlled for operation in synchronism with the copier, preferably by the logic and control unit 9.

It should be understood that the present invention contemplates modes of operation that will account for the usual variations in originals. A duplex original that ends on the first face of the last sheet, for example, need not be copied on the blank face. In a similar respect, it should be recognized that all of the capabilities that are available in accordance with the present invention need not be used in every mode. Thus, the document feeder can have a non-collating mode and a simplex mode in addition to its collating duplex mode of operation.

Numerous advantages of the present invention now should become apparent to those skilled in the art. A first copy is completed on both sides before other copies are initiated. This reduces the first-copy time. Each copy sheet passes through the fuser only once, and only after receiving both of its images, so the sheets maintain their optimal relatively humid condition in both transfer stations. The total copy path from initial supply to final exit is reduced for improved copying efficiency, especially for documents of only a few pages, and no sorter is required. Additionally, a relatively simple collating inverting document feeder is rendered possible with only a single hopper while retaining the convenience of face-up, ordered presentation of the document to the feeder.

Although the invention has been described in detail with particular reference to preferred embodiments thereof, it will be readily understood that variations and modifications can be effected within the spirit and scope of the invention as described hereinabove and as defined in the appended claims.

We claim:

1. A copier for producing duplex copies from originals, the copies and originals including support sheets having first and second faces, said copier comprising:

a process section for establishing representations of originals, said process section including an exposure position at which the support sheets of such originals are located for copying;

a document feeder comprising means for receiving the support sheets of such originals and means for circulating the original support sheets one-after-another from said receiving means, twice to said exposure position, and then back to said receiving means, said circulating means presenting to said exposure position for copying a different face of each original support sheet on successive presentations of such sheet to the exposure position; and a copy duplexing section comprising first and second transfer stations, first and second means for receiving copy support sheets, and means for feeding the copy support sheets from said first receiving means to said first and second transfer stations and then to said second receiving means, said copy feeding means presenting the first face of each copy support sheet to receive a representation from said process section in said first transfer station and the second face of each copy support sheet to receive a representation from said process section in said second transfer station.

2. A copier for producing duplex copies automatically from a duplex original, the respective copies and original including a set of support sheets having first and second faces, said copier comprising:

a process section for establishing representations of original sheets, one-representation-after-another, said process section including an exposure platen at which the original sheets are located in a position to be copied;

a document feeder including a sheet-receiving hopper spaced from said exposure platen and means for repeatedly circulating the original support sheets one-after-another from said hopper, into engagement with said platen first and second times for presenting the first and second faces for copying, and then back to said sheet-receiving hopper, said circulating means presenting to said platen for copying a different face of each original sheet each time such sheet is presented; and a copy duplexing section comprising first and second transfer stations adjacent to said process section, a supply hopper for storing the copy support sheets, an exit hopper for receiving the copy support sheets, and means for feeding the copy support sheets, one after another, from said supply hopper to said first and second transfer stations and then to said exit hopper, said copy feeding means presenting one face of each copy support sheet to receive a representation from said process section in said first transfer station and another face of such support sheet to receive a representation from said process section in said second transfer station.

3. Reproduction apparatus for producing copies from an original, the original including a set of support sheets, and each respective copy including a corresponding set of support sheets, the original and copy sheets both having first and second faces, said apparatus comprising:

a process section for establishing representations of the first and second original faces, said process section having an exposure position in which faces of the original sheets are located for copying;

a document feeder including a hopper for receiving the set of original sheets, and means for circulating and recirculating the original sheets one-after-another from said hopper, twice to said exposure position, and then back to said hopper, said circulating and recirculating means presenting to said platen for copying a different original face for each time said process section establishes a representation; and a copy duplexing section including first and second transfer stations operatively associated with said process section, a copy-sheet supply hopper, copy-sheet receiving means, and a copy feeder for feeding the copy sheets from said supply hopper, to said first and second transfer stations and then to said copy-sheet receiving means, said copy feeder including a sheet inverting device located between said first and second transfer stations, said feeder being effective to present one face of each copy sheet to receive a representation from said process section in said first transfer station and to present another face of such copy sheet to receive a representation from said process section in said second transfer station.

4. Reproduction apparatus for producing a desired number of copies from an original, the original comprising a set of support sheets having a page-sequential order on first and second faces of the support sheets, and each copy produced comprising a set of support sheets corresponding to said original set in page-sequential order on first and second faces the copy support sheets, said apparatus comprising:

a process section including an exposure station at which original sheets are positioned for copying, the process section having an optical arrangement for viewing original pages at the exposure station, and means for producing an imagewise distribution of marking particles representing an original page viewed by said optical arrangement; a document feeder comprising a hopper for receiving the original set and means for circulating the set of original support sheets one-after-another from said hopper, twice to said exposure station, and then back to said hopper, said circulating means presenting said original set to the exposure station for viewing by said optical arrangement one-page-at-a-time and in page-sequential order, last page first, and a number of times equal to the desired number of copies; and a copy duplexing section comprising first and second transfer stations positioned adjacent said process section, a copy-sheet supply hopper, a fuser, and means for feeding the copy sheets from said supply hopper, to said first and second transfer stations and then to said fuser, said feeding means including a sheet inverting device positioned adjacent to said process section and between said first and second transfer stations for inverting each copy support sheet as it is fed from the first transfer station to the second transfer station so that each sheet receives on two different faces thereof visible representations from said process section in said first and second transfer stations.

5. A copier for producing multiple copies of originals, the copies and originals each comprising a plurality of sheets having first and second faces, said copier comprising:

a document feeder comprising a hopper for receiving and supporting original sheets, an exposure station spaced from said hopper, means for circulating one-original-sheet-after-another from said hopper to said exposure station and back to said hopper, and sheet inverting means for turning the original sheets over to present both faces thereof to said expsoure station for copying;

a process section for establishing visible representations of original sheets in said exposure station, said process section including a single photoconductor for supporting latent electrostatic images of the original faces presented for copying, a plurality of processing stations for acting on said photoconductor to render the images visible, and means for moving said photoconductor relative to said stations for sequentially establishing the representations one-after-another along said photoconductor; and a duplexing section for transferring the visible representations from said photoconductor to the copy sheets, said duplexing section including first and second transfer zones, a copy sheet inverter located between said zones for inverting a copy sheet as it travels from the first zone to the second zone, and means for sequentially presenting the copy sheets one-after-another first to said first transfer zone for receiving a visible representation from said photoconductor on the first faces of the copy sheets, then to said sheet inverter for turning the copy sheets over, and then to said second transfer zone for receiving a visible representation from said photoconductor on the second faces of the copy sheets.

6. The invention as set forth in claims 1, 2, 3, 4 or 5 further comprising coordinating means for controlling said feeder repeatedly to present the original sheets to the exposure station in page-sequential order, said process section for establishing one representation for each respective presentation of an original sheet, and said duplexing section to present one copy-sheet face in synchronism with each respective establishment of a representation.

7. A copier for producing copies of an original, the copies and original each comprising a plurality of sheets having first and second faces, said copier comprising:

a document feeding section including a hopper for receiving and supporting the original sheets, an exposure station spaced from said hopper, means for circulating one-original-sheet-after-another from said hopper to said exposure station for copying and back to said hopper, and sheet inverting means for turning the original sheets over during circulation of the sheets, said circulating means presenting each face of an original sheet to the exposure station for copying;

a process section for establishing imagewise distributions of marking particles representing the original sheet faces presented to said exposure station, said process section including a photoconductor for supporting latent electrostatic images of the originals circulated to said exposure station, a developing station applying marking particles to said latent images to create the imagewise distributions, and means for moving said photoconductor relative to said stations for sequentially establishing the imagewise distributions one-after-another along said photoconductor; and a duplexing section for transferring the imagewise distributions from said photoconductor to the copy sheets, said transfer section including first and second transfer zones, a copy sheet inverter located between said zones for inverting a copy sheet as it travels from the first zone to the second zone, and means for sequentially presenting the copy sheets one-after-another first to said first transfer zone for receiving a visible representation from said photoconductor on the first faces of the copy sheets, then to said sheet inverter for turning the copy sheets over, and then to said second transfer zone for receiving a visible representation from said photoconductor on the second faces of the copy sheets.

8. A copier for producing multiple copies of an original having a page-sequential order, the original and copies respectively comprising a set of flat sheets having odd and even pages on first and second faces thereof, said copier comprising:

a process section including an exposure platen for supporting the original pages and means for establishing imagewise distributions of marking particles representing the original pages so supported;

a collating document feeder comprising a single hopper for holding the original set, and means for circulating the sheets in the original set one-after-another from said hopper twice to said exposure platen and back to said hopper, said circulating means including document inverting means for alternately presenting even and odd original pages to said exposure platen; and a copy duplexing section having first and second transfer stations, a first hopper for holding a supply of copy sheets, a second hopper for receiving copy sheets, and means for feeding the copy sheets from said first hopper twice to said process section and then to said second hopper, said feeding means including copy sheet inverting means between said transfer stations for turning copy sheets over to alternately present the second and first faces of the copy sheets, respectively, to receive the imagewise distributions representing the even and odd original pages in the second and first transfer stations.

9. Reproduction apparatus for making copies of documents, said documents including sets of sheet material having first and second faces bearing information to be copied and said copies including corresponding sets of support material bearing the copied information;

a document feeding section including an exposure position where the document sheets are positionable for copying, a document hopper for receiving the document sheets in a set of such sheets, and means for circulating the document sheets, one-after-another, from the bottom of the set in said document hopper to said exposure position for a first presentation, away from and back to said exposure position for a second presentation, and then to the top of the set in said document hopper, said circulating means including means for inverting the respective document sheets zero or an even number of times between said hopper and said exposure position, an odd number of times between the first and second presentations to said exposure position, and an odd number of times between said exposure position and said document hopper;

a process section including means for forming imagewise distributions of marking particles, one-after-another, containing information copied from the document sheets, said forming means establishing only one imagewise distribution for each respective presentation of a document sheet; and a copy duplexing section including supply and exit hoppers and means defining a path from said supply hopper to said process section and then to said exit hopper, first and second transfer stations in said path for transferring the imagewise distributions from said process section to the copy supports, a turn-around device in said path between said transfer stations for inverting the supports an odd number of times between said stations, and a fusing device in said path between said second transfer stations and said second hopper, and means for feeding copy supports in said path, one-after-another, from said first hopper to said first transfer station, through said turn-around device to said second transfer station, and then through said fuser to said second hopper.

10. A copier for providing copies from originals, the copies and originals including support sheets defining first and second faces, said copier comprising:

a process section for establishing visible representations of the original sheets, said process section including an exposure platen for supporting the original sheets to be copied;

a document feeder including a sheet receiving hopper and means for circulating the original support sheets, one-after-another, from said hopper to said platen and back to said hopper, said circulating means defining:

an original duplex path for presenting the original twice to said platen, once with the second face engaging the platen and once with the first face engaging the platen, and an original simplex path for presenting the original once to said platen, with the first face engaging the platen;

a copy section including first and second transfer stations, a supply hopper, a fuser and an exit hopper, said copy section defining:

a copy duplex path and means for feeding copy supports from said supply hopper to said first and second transfer stations, then to the fuser and then to said exit hopper, said copy feeding means presenting one face of each respective copy support to receive a visible representation from said process section in said first transfer station and another face of such support to receive a visible representation from said process section in said second transfer station; and a copy simplex path and means for feeding copy supports from said supply hopper to said first transfer station, then to the fuser and then to said exit hopper, said copy feeding means presenting the first face of each respective copy support to receive a visible representation from said process section at said first transfer station;

control means for selectively directing:

the original sheets in said original duplex path and the copy sheets in said copy duplex path to produce duplex copies from duplex originals;

the original sheets in said original simplex path and the copy sheets in said copy duplex path to produce duplex copies from simplex originals; and the original sheets in said original simplex path and the copy sheets in said copy simplex path to produce simplex copies from simplex originals.

11. A copier for producing copies from originals having first and second faces, the copies comprising support sheets having first and second faces, said copier comprising:

a process section for establishing representations of originals for transfer to support sheets;

a document feeder including means for receiving originals, and means for circulating and recirculating the originals one-after-another from said receiving means to said process section and then back to said receiving means, said circulating means presenting to said process section for copying at least one face of each original on each circulation of such original; and a copy duplexing section including first and second transfer stations at which representations of originals are transferred from the process section to copy support sheets, first and second means for receiving copy support sheets, and means for feeding the copy support sheets from said first receiving means sequentially to said first and second transfer stations and then to said second receiving means, said feeding means presenting the first face of a copy support sheet to receive a representation from said process section in said first transfer station and presenting the second face of such copy support sheet to receive a representation from said process section in said second transfer station.

12. The invention as set forth in claim 11 wherein said circulation means of said document feeder further comprises a sheet inverter for inverting an original, the sheet inverter being located so that an original is circulated from the process section through the inverter and then back to the process section a second time whereby both faces of an original are presented to said process section for copying.

13. Apparatus for producing a set of copies from an original set, the sets each including support sheets arranged in the same page sequential order; said copier comprising:

a process section having a viewing position at which pages of original sheets are located for copying, and means for producing a representation of an original page that is located at the viewing position;

a document feeder having means for receiving the original set with the first page of the set on top and facing upwardly, and means for circulating the original support sheets one-after-another from the bottom of the original set in said receiving means to said viewing position and then back to the receiving means on top of the set in said receiving means, said circulating means presenting the support sheets of said original set to said viewing position for copying sequentially, and the circulating means presenting each page of the original set to the viewing position once for each copy of such page that is produced; and a copy duplexing section comprising first and second transfer stations positioned adjacent said process section, a copy-sheet supply hopper, a fuser, and means for feeding copy sheets along a path extending from said supply hopper, to said first and second transfer stations and then to said fuser, said feeding means including a sheet inverting device positioned along said path between said first and second transfer stations for inverting a copy sheet as it travels between said transfer stations so that each copy sheet receives a representation from said process section on one face at said first transfer station and a representation from the process section on the opposite face at the second transfer station.

14. A copier for producing copies from originals having first and second faces, the copies comprising support sheets having first and second faces, said copier comprising:

a process section for establishing representations of originals for transfer to support sheets;

a recirculating document feeder comprising means for receiving originals, and sheet presenting means for sequentially removing document sheets from the receiving means and presenting the removed sheets to the process section, said sheet presenting means comprising means defining a non-inverting sheet path leading from the receiving means to the process section so that sheets can be advanced along such path from the receiving means to the process section with the same face of the sheet facing upwardly in the receiving means and in the process section, said presenting means further comprising a first sheet inverting path for inverting a sheet as it travels between the receiving means and the process section so that the face of the sheet that faces upwardly in the receiving means is inverted to face downwardly in the process section, a sheet returning means comprising a sheet path extending from the process section to the receiving means, said returning means being shaped to invert a document sheet once as it travels from the process section to the receiving means, and a second sheet inverting path located with respect to the process section for receiving a sheet fed from the process section and for returning the sheet to the process section with the sheet being inverted as it travels through the second sheet inverting path so that a second face of the sheet is presented to the process section; and a copy section including a transfer section at which representations of originals are transferred from the process section to copy support sheets, first and second means for receiving copy support sheets, and means for feeding the copy support sheets from said first receiving means to said transfer station and then to said second receiving means.

15. The invention as set forth in claim 14 wherein said non-inverting sheet path comprises a closed end passageway, and the invention further comprising a diverter movable between first and second positions and being located with respect to said passageway and said first sheet invertng path so that (1) the diverter is effective in its first position to direct original sheets fed from the receiving means into the first inverting path and (2) the diverter is effective in its second position to direct original sheets fed from the receiving means into the non-inverting path.

16. A recirculating document feeder for feeding one or more document sheets to an exposure position for copying of the sheets, the feeder comprising:

a hopper spaced from the exposure position and adapted to receive a set of document sheets in their normal page sequential order; and sheet presenting means for sequentially removing document sheets from the hopper and presenting the removed sheets to the exposure position, such sheet presenting means comprising means defining a non-inverting sheet path leading from the hopper to the exposure position so that sheets are advanced along such path from the hopper to the exposure position with the same face of the sheet facing upwardly in the hopper and in the exposure position, and said presenting means further comprising a sheet inverting path for inverting a sheet as it travels between the hopper and the exposure position so that the face of the sheet that faces upwardly in the hopper is inverted to face downwardly in the exposure position, and sheet returning means comprising a sheet path extending from the exposure position to the hopper, said returning means being shaped to invert a document sheet once as it travels from the exposure position to the hopper.

17. The invention as set forth in claim 16 wherein said presenting means further comprises a second sheet inverting path located with respect to the exposure position for receiving a sheet fed from the exposure position and for returning the sheet to the exposure position with the sheet being inverted as it travels through the second sheet inverting path so that as it travels through the second sheet inverting path so that a second face of the sheet is presented for exposure; and means for controlling the feeding of a document sheet into the inverting or non-inverting paths so that one or both faces of a document sheet can be presented at the exposure position for copying of the document sheet.

18. The invention as set forth in claim 16 wherein said hopper is positioned above the exposure position, the non-inverting sheet path comprises a closed-end passageway, and the invention further comprises drive means for advancing a sheet in a first direction for feeding the sheet into the passageway and for advancing a sheet in a second direction for feeding the sheet out of the passageway.

19. A recirculating document feeder for feeding one or more document sheets to an exposure position for copying of the sheets, the feeder comprising:

a hopper spaced from the exposure postion and adapted to receive a set of document sheets in a predetermined page sequential order; and sheet presenting means for sequentially removing document sheets from the hopper and presenting the removed sheets to the exposure position, such sheet presenting means comprising means defining a non-inverting sheet path leading from the hopper to the exposure position so that sheets are advanced along such path from the hopper to the exposure position with the same face of the sheet facing downwardly in the hopper and in the exposure position, and said presenting means further comprising means defining a sheet inverting path leading from and returning to the exposure position for receiving a sheet fed from the exposure position and inverting the sheet as it travels through the sheet inverting path so that upon return to the exposure position a second face of the sheet is presented for exposure, and sheet returning means comprising means defining a sheet path extending from the exposure position to the hopper, said returning means being shaped to invert a document sheet once as it travels from the exposure position to the hopper.

20. A recirculating document feeder for feeding one or more document sheets to an exposure position for copying of the sheets, the feeder comprising:

a document hopper for receiving the document sheets in a set of such sheets, and means for circulating the document sheets, one-after-another, from the bottom of the set in said document hopper to said exposure position for a first presentation, away from and back to said exposure position for a second presentation, and then to the top of the set in said document hopper, said circulating means including means for inverting the respective document sheets zero or an even number of times between said hopper and the first presentation at said exposure position, an odd number of times between the first and second presentations to said exposure position, and an odd number of times between the second presentation at said exposure position and said document hopper.

21. The invention as set forth in claim 20 wherein said circulating means further comprises means for inverting the respective document sheets an odd number of times between said hopper and the first presentation at said exposure position, and the invention further comprising means for controlling said circulating means to present either one face or both faces of a document sheet to the exposure position for copying.

* * * * *